United States Patent [19]

Reusch

[11] 4,104,806

[45] Aug. 8, 1978

[54] METHOD OF FLUIDIZED BED DRYING

[75] Inventor: Robert J. Reusch, Ponca City, Okla.

[73] Assignee: Continental Oil Company, Ponca City, Okla.

[21] Appl. No.: 802,697

[22] Filed: Jun. 2, 1977

[51] Int. Cl.[2] ..... F26B 3/08

[52] U.S. Cl. ..... 34/10; 264/117

[58] Field of Search ..... 34/10, 57; 264/117

[56] References Cited

U.S. PATENT DOCUMENTS 3,513,561 5/1970 Meyer et al. ..... 34/10

*Primary Examiner*—Leland A. Sebastian

*Attorney, Agent, or Firm*—Bayless E. Rutherford, Jr.

[57] ABSTRACT

An improved method of drying particulate matter, subject to agglomeration, by fluidized bed drying is disclosed. The improvement of the method comprises adding an effective amount of a fluidizing agent to the particulate matter prior to drying.

18 Claims, No Drawings

METHOD OF FLUIDIZED BED DRYING

FIELD OF THE INVENTION

The invention is in the general field of fluidized bed drying of particulate matter, particularly the type that is subject to agglomeration.

GENERAL BACKGROUND

Fluidized bed drying is a well-known chemical process technique. Briefly, it may be described as a method wherein a flowing gas (usually heated) suspends a bed of granular material which is being dryed. The system is reported to have high thermal efficiency due to the intimate contact of the drying gas with the wet particles.

Fluidized bed drying is useful for drying a wide variety of products. For example it has been used to dry polymers, such as polyacrylonitrile, polycarbonate, polyethylene polyvinyl acetate, polyvinyl chloride and ureaformaldehyde resin; also, it has been used to dry chemicals such as ammonium sulfate, sodium sulfate, and boric acid; further, it has been used to dry pharmaceutical products, still further, it has been used to dry foodstuffs, such as baby food, salt, sugar, coffee, cocoa mixtures, and coffee whiteners; moreover, it has been used to dry materials such as sawdust, sand and grains.

While fluidized bed drying has been used to dry polyvinyl chloride, some problems are present in this use due to the tendency for the resin particles to agglomerate. One means of overcoming this problem is disclosed in U.S. Pat. No. 3,494,046. This patent solves the problem by use of an improved fluidized bed drying apparatus.

My invention provides a solution to the problem of fluidized bed drying of particulate matter and particularly the type which is subject to agglomeration. Moreover, my invention does not require a particular type of apparatus as the dryer.

Briefly, my invention comprises adding an effective amount of a fluidizing agent, as described hereinafter, to the particulate matter prior to drying.

PRIOR ART

Both a computer and a Chemical Abstracts search were conducted on the prior art. From these searches the following patents are considered of sufficient interest to warrant discussion.

U.S. Pat. No. 3,494,046 teaches fluidized bed drying to polyvinyl chloride resin. This patent is directed to an improved apparatus and has been mentioned in the "General Background" section.

U.S. Pat. No. 3,054,786 teaches the addition of calcium stearate to polyvinyl chloride. The material is added to the polymerization recipe. A material such as glycerol monostearate is also added to the resin. The combination of these materials results in a resin having a high degree of lubricity as well as heat stability and light stability.

U.S. Pat. No. 3,216,957 teaches the use of numerous materials as anti-static agents in polyvinyl chloride resin. Calcium stearate is taught as a suitable anti-static agent. The patent is directed to improved polyvinyl chloride composition for use as a sound record.

In summary, none of the above patents teach improved fluidized bed drying by the addition of a fluidizing agent (e.g. calcium stearate).

BRIEF SUMMARY OF THE INVENTION

Briefly stated, the present invention is directed to an improvement in the method of drying particulate matter by fluidized bed drying wherein the improvement comprises adding an effective amount of a fluidizing agent to the particulate matter prior to drying.

In a preferred embodiment the particulate matter is a type which is subject to agglomeration.

DETAILED DESCRIPTION

Examples of suitable particulate materials which can be dried by fluidized bed drying have been given in the section on "General Background." Polymers which are subject to agglomeration are particularly suitable in my process.

A variety of materials are suitable as fluidizing agents. Suitable fluidizing agents include the following:

(a) carboxylic acids and the metal salts and esters thereof, wherein the carboxylic acids are normal or branched hydrocarbon chain with the chain containing about 16 to about 30 carbon atoms, (b) metal salts of alkyl sulfonates and alcohol sulfates wherein the hydrocarbon chain contains about 16 to about 30 carbon atoms, (c) phosphorus compounds represented by the formula

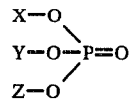

wherein X, Y and Z are hydrogen, a $C_{16}$–$C_{30}$ alkyl group or a metal cation (preferably monovalent), with at least one of X, Y, and Z being a $C_{16}$–$C_{30}$ alkyl group, (d) quaternary ammonium compounds represented by the formula

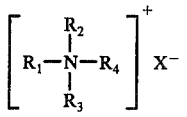

wherein $R_1$ is an alkyl containing about 16 to about 30 carbon atoms, $R_2$, $R_3$, and $R_4$ are alkyl groups containing from 1 to 28 carbon atoms, with the total number of carbon atoms in $R_2$, $R_3$, and $R_4$ being not more than 30, and wherein X is halogen, preferably chlorine, or a sulfate.

Suitable metals for the compounds described in the foregoing include alkali and alkaline earth metals. The preferred metals are sodium, potassium, calcium and magnesium.

Examples of suitable fluidizing agents include the following: stearic acid, behenic acid, triacontanoic acid, sodium stearate, calcium stearate, butyl stearate, glycerol monostearate, glycerol tristearate, glycerol monoisostearate, sodium hexadecyl sulfonate, magnesium octadecyl sulfonate, calcium octadecanol sulfate, sodium eicosanol sulfate, monooctadecyl phosphoric acid, sodium monooctadecyl phosphate, trihexadecyl phosphate, octadecyl trimethyl amine chloride, octadecyl trimethyl amine sulfate, octadecyl tributyl amine chloride, and octadecyl trioctyl amine chloride.

The amount of fluidizing agent, based on the particulate matter, is as follows:

| | Parts per hundred parts of particulate matter (wt. %) |
|---|---|
| Suitable | 0.005 – 0.25 |
| Preferred | 0.02 – 0.10 |

Amounts higher than 0.25 on the stated basis can be used but it is not necessary and is not economical.

The fluidizing agent can be added to the particulate matter at any time prior to going to the fluidized bed dryer. In the specific case of polymer-water slurry the fluidizing agent can be added at any time after leaving the reactor and prior to going to the fluidized bed dryer.

In order to illustrate the nature of the present invention still more clearly the following examples will be given. It is to be understood, however, that the invention is not to be limited to the specific conditions or details set forth in these examples except insofar as such limitations are specified in the appended claims.

EXAMPLE 1

This example shows drying a water slurry containing polyvinyl chloride resin in a bench scale fluid bed dryer using calcium stearate as the fluidizing agent. Under carefully controlled conditions the resin was dried with the addition of calcium stearate and without the addition of calcium stearate. The water-polyvinyl chloride slurry was centrifuged to reduce the water content of the slurry to about 25 percent by weight. Calcium stearate (0.06 part per 100 parts resin) was then added to the slurry. The slurry then was passed through the dryer.

During the drying process, samples were drawn from the bed and the moisture content of the resin was determined. In this manner the time versus moisture content could be plotted if desired, or simply shown in a table. In addition, microscopic pictures were taken of the various samples of dried resin. In the present example the moisture versus drying time were substantially the same down to 1% moisture. The differences below 1% moisture are shown in the following table.

| | Moisture content (weight % $H_2O$) | |
|---|---|---|
| Time (min.) | Resin with Ca stearate | Resin without Ca stearate |
| 1 | — | 0.5 |
| 3 | 0.15 | — |
| 6 | — | 0.2 |
| 8 | 0.12 | — |
| 11 | — | 0.18 |
| 19 | 0.10 | — |
| 21 | — | 0.15 |
| 28 | 0.07 | — |
| 31 | — | 0.12 |

Photographs of the resin without the fluidizing agent showed that they had a tendency to agglomerate. Photographs of the resin with the fluidizing agent showed that the particles were well segregated.

EXAMPLE 2

This example shows the advantage of drying a water-polyvinyl chloride slurry containing calcium stearate as the fluidizing agent in a larger fluidized bed dryer than used in Example 1. Two runs were made, one containing calcium stearate, the other not containing it. The run conditions were substantially the same. The water-polyvinyl chloride slurry was centrifuged to reduce the water content to about 25 weight percent. The fluidized bed dryer was 36 $ft^2$ bed. The drying air was at a temperature of 93° C. In the run containing calcium stearate the amount was 0.05 part per hundred parts polyvinyl chloride. The feed rate and percent water in the resin product in the two runs are shown below.

| | Feed Rate (lbs/hr) | % Water Product |
|---|---|---|
| Run A with Ca stearate | 850 | 0.03 |
| Run B no Ca stearate | 755 | 0.20 |

It should be noted that an amount of water in the product as low as 0.03% is considered to be unusually low.

Thus, having described the invention in detail, it will be understood by those skilled in the art that certain variations and modifications may be made without departing from the spirit and scope of the invention as defined herein and in the appended claims.

I claim:

1. In the method of drying particulate matter by fluidized bed drying the improvement comprising adding an effective amount, in the range of about 0.005 to about 0.25 parts by weight per hundred parts of particulate matter, of a fluidizing agent selected from the group consisting of:

(a) carboxylic acids and the metal salts and esters thereof, wherein the carboxylic acids are normal or branched hydrocarbon chain with the chain containing about 16 to about 30 carbon atoms, (b) metal salts of alkyl sulfonates and alcohol sulfates wherein the hydrocarbon chain contains about 16 to about 30 carbon atoms, (c) phosphorus compounds represented by the formula

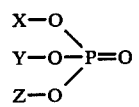

wherein X, Y and Z are hydrogen, a $C_{16}$–$C_{30}$ alkyl group or a metal cation with at least one of X, Y, and Z being a $C_{16}$–$C_{30}$ alkyl group, (d) quaternary ammonium compounds represented by the formula

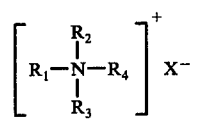

wherein $R_1$ is an alkyl group containing about 16 to about 30 carbon atoms, $R_2$, $R_3$, and $R_4$ are alkyl groups containing from 1 to 28 carbon atoms, with the total number of carbon atoms in $R_2$, $R_3$, and $R_4$ being not more than 30, and wherein X is halogen or sulfate.

2. The method of claim 1 wherein the particulate is subject to agglomeration.

3. The method of claim 2 wherein the amount of fluidizing agent is about 0.02 to about 0.10 parts per hundred parts of particulate matter.

4. The method of claim 1 wherein the fluidizing agent is a carboxylic acid, the metal salt or ester thereof, wherein the carboxylic acid is a normal or branched hydrocarbon chain containing about 16 to about 30 carbon atoms.

5. The method of claim 4 wherein the fluidizing agent is calcium stearate.

6. The method of claim 1 wherein the fluidizing agent is an alkali or alkaline earth metal salt of an alkyl sulfonate or alcohol sulfate wherein the hydrocarbon chain contains about 16 to about 30 carbon atoms.

7. The method of claim 1 wherein the fluidizing agent is a phosphorus compound represented by the formula

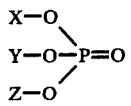

wherein X, Y and Z are hydrogen, a $C_{16}$–$C_{30}$ alkyl group or an alkali or alkaline earth metal cation, with at least one of X, Y and Z being a $C_{16}$–$C_{30}$ alkyl group.

8. The method of claim 1 wherein the fluidizing agent is a quaternary ammonium compound represented by the formula

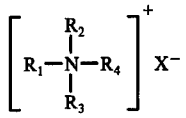

wherein $R_1$ is an alkyl group containing about 16 to about 30 carbon atoms, $R_2$, $R_3$, and $R_4$ are alkyl groups containing from 1 to 28 carbon atoms, with the total number of carbon atoms in $R_2$, $R_3$ and $R_4$ being not more than 30, and wherein X is halogen or sulfate.

9. The method of claim 4 wherein the particulate matter is a polymer.

10. The method of claim 9 wherein the particulate matter is polyvinyl chloride.

11. The method of claim 5 wherein the particulate matter is a polymer.

12. The method of claim 11 wherein the particulate matter is polyvinyl chloride.

13. The method of claim 6 wherein the particulate matter is a polymer.

14. The method of claim 13 wherein the particulate matter is polyvinyl chloride.

15. The method of claim 7 wherein the particulate matter is a polymer.

16. The method of claim 15 wherein the particulate matter is polyvinyl chloride.

17. The method of claim 8 wherein the particulate matter is a polymer.

18. The method of claim 17 wherein the particulate matter is polyvinyl chloride.

* * * * *